United States Patent [19]

Van Mensvoort

[11] Patent Number: 4,753,822

[45] Date of Patent: Jun. 28, 1988

[54] METHOD OF PROVIDING A BONDING, ELECTRICALLY INSULATING LAYER, METAL RIBBON COATED WITH SUCH A LAYER, AND LOW-LOSS MAGNET CORE

[75] Inventor: Adrianus J. Van Mensvoort, Eindhoven, Netherlands

[73] Assignee: U.S. Philips Corp., New York, N.Y.

[21] Appl. No.: 918,177

[22] Filed: Oct. 10, 1986

[30] Foreign Application Priority Data

Oct. 18, 1985 [NL] Netherlands ..... 8502849

[51] Int. Cl.[4] ..... B05D 5/06

[52] U.S. Cl. ..... 427/126.3; 427/226; 427/287; 427/387; 427/429; 29/609

[58] Field of Search ..... 427/126.3, 226, 287, 427/387, 429; 29/609

[56] References Cited

U.S. PATENT DOCUMENTS 2,261,983 11/1941 Ford ..... 29/609

2,796,364 6/1957 Suchoff ..... 427/126.3

4,413,406 11/1983 Bennett et al. ..... 29/609

*Primary Examiner*—John E. Kittle

*Assistant Examiner*—Patrick J. Ryan

*Attorney, Agent, or Firm*—Norman N. Spain

[57] ABSTRACT

The invention relates to a metal ribbon and a method of manufacturing same, in which a layer or track of magnesium oxide is provided on the metal ribbon by decomposition of magnesium alcoholate which is provided by means of a dosing system which is sealed from the air. A sinusoidal information track of magnesium oxide is preferably used. A layer of silicon oxide to be manufactured by thermal decomposition of a liquid silicon compound may be used instead of magnesium oxide.

A magnet core which is formed by winding the metal ribbon succeeded by impregnation with epoxy resin is particularly suitable for use at high frequency because interlaminar eddy currents are suppressed.

5 Claims, 2 Drawing Sheets

METHOD OF PROVIDING A BONDING, ELECTRICALLY INSULATING LAYER, METAL RIBBON COATED WITH SUCH A LAYER, AND LOW-LOSS MAGNET CORE

BACKGROUND OF THE INVENTION

The invention relates to a method of providing a surface with an electrically insulating layer bound to the surface, in which a solution of magnesium alcoholate is provided on the surface, after which the solvent is evaporated by means of applied thermal energy and the magnesium alcoholate is decomposed, magnesium oxide being formed.

The invention further relates to a method of providing a metal ribbon with an electrically insulating layer bound to a metal ribbon.

The invention moreover relates to a metal ribbon covered with an electrically insulating layer bound thereto.

Finally the invention relates to a low-loss magnet core for electromagnetic applications, which magnet core is formed from a laminate of amorphous metal layers in which an electrically insulating material is provided between the laminations.

An electrically insulating layer is bound to, for example, amorphous metal ribbons which are used as a magnet core material, for example, for transformer cores. The insulating layer serves to suppress eddy currents in the magnet core which consists of a laminate which is formed, for example, by winding a metal ribbon to the desired shape on a surface.

A method of providing a magnesium oxide layer is disclosed in U.S. Pat. No. 2,796,364 in which magnesium is added to, for example, methanol to manufacture a solution of magnesium methanolate in methanol. The solution is then provided on a surface by dipping or spraying, after which the surface is heated, the solvent evaporating, and a layer of magnesium oxide formed is bonded to the surface. The solution comprises water which is preferably removed before the solution is provided on the surface.

SUMMARY OF THE INVENTION

It is an object of the invention to provide a method of providing a particularly uniform layer of magnesium oxide the layer thickness of which can be accurately adjusted.

According to the invention this object is achieved by means of a method as described in the opening paragraph which method is characterized in that the solution of magnesium alcoholate is applied to the surface by means of an applicator which the solution is sealed from the air until contacting the surface.

Experiments have demonstrated that the presence of water, also from the ambient air, leads to problems when using a magnesium alcoholate solution, in particular upon drying, because a good adjustment of the layer thickness of the formed magnesium oxide is disturbed. This is disadvantageous in particular when it is endeavoured, as in the present case, to use a small quantity of magnesium oxide.

In a preferred embodiment of the method in accordance with the invention the solution of magnesium alcoholate is provided on the surface by means of a felt pen.

A further object of the invention is to provide a method of providing an insulating magnesium oxide layer in which a small quantity of magnesium alcoholate is used, in which the required heat for evaporating the composition is reduced as compared with the so far known methods, and in which the speed of providing the insulating layer is increased as compared with known methods.

This object is achieved in an embodiment of the method in accordance with the invention which is characterized in that the surface is covered in the form of a pattern with a layer of magnesium oxide by providing the solution of magnesium alcoholate on a part of the surface. The usefullness of this method is based on the experimentally gained recognition that the presence of an insulating layer on only a part of the surface is in many cases sufficient to suppress the occurrence of eddy currents, for example, when using a metal ribbon in a laminated form in a magnet core. The insulating layer serves as a spacer between the laminations. This method has the additional advantage that, as a result of this spacing between the laminations, the formed magnet core can simply be impregnated, for example, with an epoxy resin, which serves to improve the bonding between the laminations and the resistance to deformation of the magnet core.

A particularly suitable embodiment of the method in accordance with the invention of providing a layer of magnesium oxide on a metal ribbon which is moved at a uniform speed is characterized in that a sinusoidal insulation track is formed on the surface by moving the felt pen in a direction which is substantially perpendicular to the direction of movement of the ribbon.

Although a method is known from U.S. Pat. No. 4,413,406 according to which a, for example sinusoidal, track is provided on a metal ribbon, this method relates to a low-melting-point metal which serves to improve the bonding between the laminations. From the fact that a partial connection is sufficient to ensure bonding, however, it may not be concluded that a partial insulation is sufficient to suppress electrical conductivity to the desired extent.

A further object of the invention is to provide a method of providing an electrically insulating layer bonded to a metal ribbon in which a small quantity of insulating material is required, in which a small quantity of thermal energy is consumed, and in which a high speed of providing the insulating layer on the metal screen can be achieved.

According to this aspect of the invention this object is achieved by means of a method which is characterized in that a sinusoidal track of a liquid silicon compound is provided on at least one surface of the metal ribbon, which silicon compound is then decomposed by supplying thermal energy, silicon oxide being formed.

This method can be combined particularly efficaciously with the manufacture of a magnet core from the metal ribbon in which the metal ribbon is wound to the desired shape, after which the magnet core is annealed, for example at 400° C., to remove mechanical stresses from the magnet core, after which the magnet core is impregnated, for example, with an epoxy resin. During annealing the liquid silicon compound is converted into silicon oxide so that no separate step in the method is necessary for this purpose. Since the metal ribbon is covered only locally with silicon oxide, the laminations of the magnet core can be bonded together in a strongly adhering manner by impregnating the wound magnet core with a synthetic resin.

Still another object of the invention is to provide a metal ribbon which is covered with a bonded, electrically insulating layer, in which a small quantity of insulating material is consumed and in which the insulating layer can be provided at a high speed. The metal ribbon must further be suitable to be used in a laminated form as a magnet core material in which eddy currents are suppressed to a considerable extent, notably also when the magnet core is used at a high frequency. Moreover it is desired that the laminations can be bonded together in a strongly adhering manner, for example, by impregnating the wound magnet core with an epoxy resin.

This object is achieved according to the invention by a metal ribbon as described in the opening paragraph, which metal ribbon is characterized in that it is covered in the form of a pattern with a layer of a material selected from the group consisting of magnesium oxide and silicon oxide.

In a preferred embodiment a surface of the metal ribbon is covered with a sinusoidal insulation track.

In a particularly efficacious embodiment of the metal ribbon according to the invention the insulation track has a width from 0.1 to 1 mm and a thickness of from 0.2 to 1 μm.

The thickness of the insulation track should be at least 0.2 μm to ensure that the insulating track serves satisfactorily as a spacer between the laminations in the further working of the metal ribbon, for example, to manufacture a magnet core. When the height of the insulation track is more than 1 μm, the volume of non-magnetically active material in the magnet core increases undesirably. The width of the insulation track is large with respect to the height to produce a sufficient action as a spacer and because, when the width is sufficiently large, the thickness can be controlled reliably. When the width of the insulation track exceeds 1 mm, the desired saving of magnesium alcoholate, of thermal energy to be employed and of processing time does not occur to a sufficient extent.

A final object of the invention is to provide a magnet core for electromagnetic applications, which magnet core shows low losses, in particular also when used at high frequencies, which magnet core is formed from a laminate of amorphous metal layers, in which an electrically insulating layer is provided between the laminations. It is desired for the laminations to be bonded together in a strongly adhering manner.

According to the invention this object is achieved by means of a magnet core which is characterized in that the laminations are covered on at least one side in the form of a pattern with a material selected from the group formed by magnesium oxide and silicon oxide and that the magnet core is impregnated with a synthetic resin.

DESCRIPTION OF THE PREFERRED EMBODIMENTS

Figure 1A:
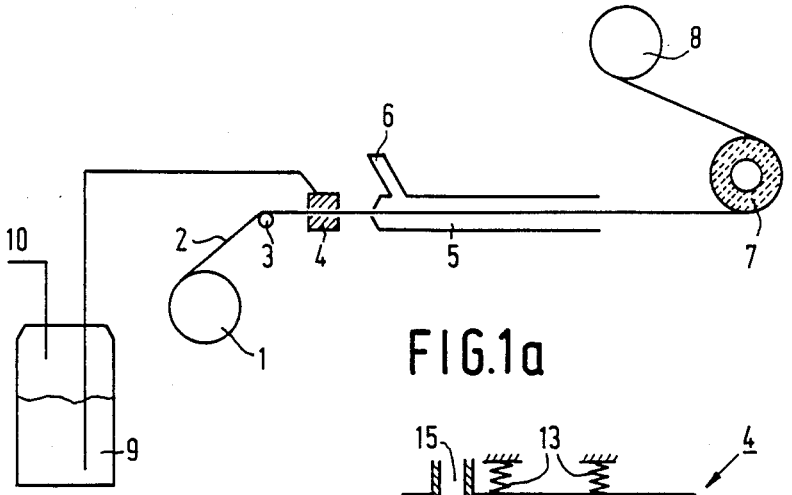
FIGS. 1*a* and 1*b* show an embodiment of the method according to the invention.

The invention will now be described in greater detail with reference to the drawing and the following examples.

EXAMPLE 1

FIG. 1*a* shows diagrammatically an embodiment of the method according to the invention. A metal ribbon 2 is guided from a rail 1 via a pulley 3 through a ribbon wetting device 4. According to this example the metal ribbon is an amorphous metal ribbon having a width of 12 mm and a thickness of 20 μm., The composition of the metal ribbon is chosen to be such that the metal ribbon is suitable for use for the manufacture of a magnet core, for example, $Fe_{79}B_{16}Si_5$. Otherwise, the method according to the invention may be used without any problems with any desired dimension and composition of the metal ribbon.

The metal ribbon 2 is moved through the ribbon wetting device 4 at a uniform speed, the ribbon being covered with a solution of 5% by weight of magnesium ethanolate in methanol. The metal ribbon 2 is then guided through a dryer 5, through which hot air is passed over the surface of the metal ribbon via an inlet 6. The solvent (methanol) evaporates and the magnesium ethanolate decomposes into magnesium oxide and a gaseous residue which is removed with the solvent by the hot air. The magnesium oxide remains as an electrically insulating layer bonds to the surface of the metal ribbon. According to this example the hot air has a temperature of 150° C. For drying and decomposing, other methods may, of course, also be used, for example, exposure to radiation of infrared lamps.

Finally the metal ribbon 2 is wound on a reel 8 via a transport wheel 7 having a rubber bearing surface. As a result of the continuous method and uniform speed of movement of the metal ribbon, the method according to the invention may be combined, if so desired, with other processes of the metal ribbon, for example, cutting the metal ribbon to the desired width.

The magnesium ethanolate solution is applied to the ribbon wetting device 4 from a storage tank 9 by means of gas pressure, for which purpose an inert gas, for example, argon is supplied via the inlet 10. The gas pressure can efficaciously be used to adjust the flow of liquid to the ribbon wetting device 4 and hence to adjust the thickness of the liquid film on the metal ribbon 2 at will.

Preferably, an alcohol is used as a solvent which evaporates at low temperature, for example methanol, ethanol or isopropanol. The magnesium alcoholate is preferably chosen from the group formed by magnesium methanolate and magnesium ethanolate. The concentration of the magnesium alcoholate in the solution amounts for example to 1 to 10% by weight dependent on the desired viscosity of the solution.

Figure 1B:
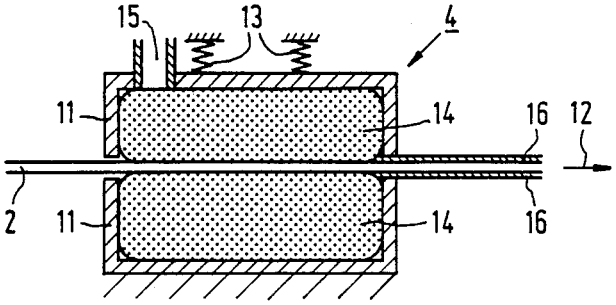

FIG. 1*b* shows in greater detail an embodiment of the ribbon wetting device 4 as it may be used in the above-described method. The ribbon wetting device 4 comprises two parts 11 between which the metal ribbon 2 is passed in the transport direction which is indicated by the arrow 12. By means of pressure springs 13 the parts 11 of the ribbon wetting device 4 are urged against each other. In the two parts 11 plugs 14 of a porous material, for example felt or a sponge, are present which are wetted with the magnesium alcoholate solution via an inlet 15. The width of the plugs 14 exceeds the width of the metal ribbon 2 so that the metal ribbon 2 is coated with liquid layers 16 on both sides over its entire width.

EXAMPLE 2

Figure 2A:
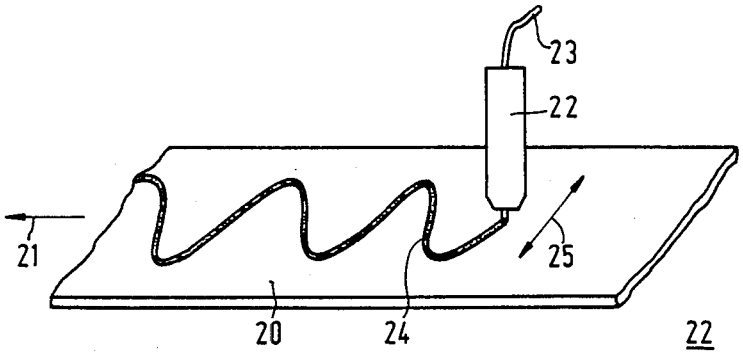
FIGS. 2*a* and 2*b* show an alternative embodiment of the method according to the invention.

FIG. 2*a* shows diagrammatically an alternative embodiment of the method in accordance with the invention. A metal ribbon 20 as described in the previous example is moved at a uniform speed in the direction of the arrow 21. A ribbon wetting device 22 is connected, via a hose 23, to a dosing device not shown in the drawing. A track 24 of a 5% by weight magnesium ethanolate solution in methanol is provided on the metal ribbon 20. The ribbon wetting device 22 is reciprocated in the direction indicated by the arrow 25 so that the track 24 varies sinusoidally.

The metal ribbon 20 is then heated in the above-described manner so that a sinusoidal track of magnesium oxide is formed on the surface.

Figure 2B:
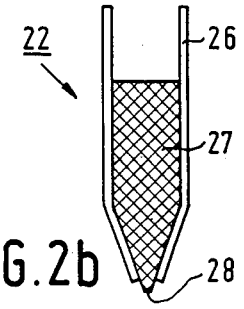

FIG. 2*b* shows in greater detail the ribbon wetting device 22 in the form of felt pen which consists of a felt holder 26 which is filled with a porous material 27 for example of felt or a sponge, the end 28 of which has a width which corresponds to the desired width of the magnesium alcoholate track.

Figure 3:
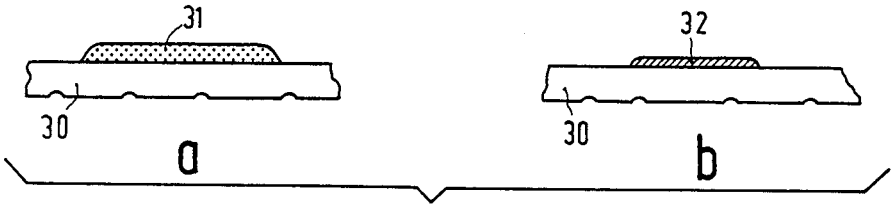
FIGS. 3*a* and 3*b* are sectional views of a metal ribbon according to the invention before and after, respectively, the thermal treatment of the metal ribbon.

FIG. 3*a* is a sectional view through a metal ribbon 30 having a track 31 of a 5% by weight magnesium ethanolate solution in methanol. Because an amorphous metal ribbon is generally manufactured by cooling a molten mixture of components at a high speed on a rotating cooled wheel, such a metal ribbon often has one rough and one smooth surface. The liquid track 31 which need be provided on one side only to obtain the desired effect is preferably provided on the smooth surface. The width of the liquid track is, for example, 0.1 to 2 mm, the thickness is from 1 to 10 μm.

FIG. 3*b* is a sectional view through the metal ribbon 30 after the thermal treatment. A track 32 of solid magnesium oxide has formed which is bonded to the metal ribbon in a readily adhering manner. After the thermal treatment the width of the track 32 is preferably from 0.1 to 1 mm, the thickness is from 0.2 to 1 μm. The extent to which the width and the thickness of the track decrease upon drying and upon the conversion into magnesium oxide depends on the concentration of the magnesium alcoholate solution used and is reproducible. A simple experiment suffices to establish which dimensions the liquid track 32 should have to give the insulation track 32 the desired dimensions.

Figure 4A:
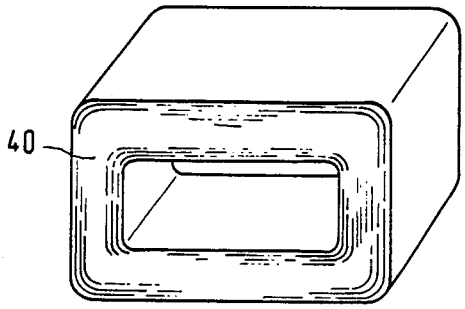
FIGS. 4*a* and 4*b* show diagrammatically a magnet core manufactured while using a metal ribbon according to the invention.

FIG. 4*a* shows diagrammatically an example of a magnet core 40 manufactured by winding a metal ribbon to the desired shape. After winding the metal core is annealed, for example, at a temperature of 400° C. to remove mechanical stresses and is then impregnated, for example, with an epoxy resin. As a result of the presence of a magnesium oxide track the epoxy resin can easily flow between the laminations so that a good bonding between the laminations is formed. The magnet core 40 may then be sawed, for example, into two core halves.

Figure 4B:
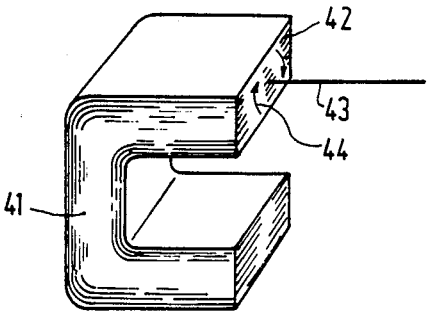

FIG. 4*b* shows one core half 41. When this core half is used the magnet field 42 is perpendicular to the surface 43. The eddy currents which are induced thereby travel in a plane perpendicular to the magnetic field, see the arrows 44. For covering a great part of their way the electrons must travel from lamination to lamination. Due to the presence of epoxy resin and magnesium oxide between the laminations the electric resistance is sufficiently high to prevent the magnetic field from giving rise to large interlaminar eddy currents.

EXAMPLE 3

An amorphous metal ribbon as described in example 1 is covered with a sinusoidal track of liquid silicon compound, for example silicon oil or silicon lacquer. The liquid is provided, for example, in the same manner and with the same dimensions as in the previous example.

The metal ribbon is then wound into a magnet core and annealed, for example, at a temperature of 400 ° C. to remove mechanical stresses. During annealing the silicon compound decomposes, a silicon oxide track being formed. The silicon oxide track has a good electrically insulating effect and moreover serves as a spacer between the laminations. The magnet core is then impregnated with epoxy resin so that a mechanically strong magnet core is formed in which interlaminar eddy currents are suppressed to a high extent during use.

What is claimed is:

1. A method of providing an electrically insulating layer bonded to a surface, in which a solution of magnesium alcoholate is provided on the surface, after which the solvent is evaporated by means of applied thermal energy and the magnesium alcoholate is decomposed thereby forming magnesium oxide, characterized in that the solution of magnesium alcoholate is provided on the surface by means of an applicator in which said solution is sealed from the air until applied to the surface.

2. A method as claimed in claim 1, characterized in that the solution of magnesium alcoholate is provided on the surface by means of a felt pen.

3. A method as claimed in claim 2, characterized in that the surface is covered in the form of a pattern with a layer of magnesium oxide by providing the solution of magnesium alcoholate on a part of the surface.

4. A method as claimed in claim 3 for providing a layer of magnesium oxide on a metal ribbon which is moved at a uniform speed, characterized in that a sinusoidal insulation track is formed on the surface by moving the felt pen in a direction which is substantially perpendicular to the direction of movement of the ribbon.

5. A method, of providing an electrically insulating layer bonded to a metal ribbon, characterized in that a sinusoidal track of a liquid silicon compound is provided on at least one surface of the metal ribbon, which silicon compound is decomposed by supplying thermal energy, thereby forming silicon oxide.

* * * * *